US005316081A

United States Patent [19]

Baski et al.

[11] Patent Number: 5,316,081

[45] Date of Patent: May 31, 1994

[54] FLOW AND PRESSURE CONTROL PACKER VALVE

[75] Inventors: Henry A. Baski, Denver; Emil Hauck, Littleton, both of Colo.

[73] Assignee: Baski Water Instruments, Denver, Colo.

[21] Appl. No.: 27,839

[22] Filed: Mar. 8, 1993

[51] Int. Cl.[5] ..... E21B 33/00; E21B 23/00

[52] U.S. Cl. ..... 166/188

[58] Field of Search ..... 166/183, 184, 185, 188, 166/129, 133, 387

[56] References Cited

U.S. PATENT DOCUMENTS

| | | | |
|---|---|---|---|
| 3,960,211 | 6/1976 | Hutchinson | 166/187 |
| 4,013,124 | 3/1977 | Hutchinson | 166/250 |
| 4,098,341 | 7/1978 | Lewis | 166/314 |
| 4,540,047 | 9/1985 | Akkerman | 166/188 |
| 4,577,696 | 3/1986 | Suman | 166/387 |
| 4,580,632 | 4/1986 | Reardon | 166/186 X |
| 4,640,351 | 2/1987 | Clifton et al. | 166/186 X |
| 4,823,882 | 4/1989 | Stokley et al. | 166/188 X |
| 4,834,176 | 5/1989 | Renfroe, Jr. | 166/142 |

OTHER PUBLICATIONS

VALTEK brochure, date unknown.

*Primary Examiner*—Thuy M. Bui

*Attorney, Agent, or Firm*—Stephen A. Gratton

[57] ABSTRACT

A packer valve for regulating the fluid flow rate and pressure within a fluid conduit such as a well, includes a housing, and an inflatable packer element mounted on an elongated mandrel. The inside diameter of the housing is formed with an arrangement of annular grooves which circumscribe the inflatable packer element. The inflatable packer element is adapted to adjust an annulus between the housing and the inflatable packer element to provide complete shutoff of fluid flow or to provide a tortuous flow path for fluid flow within the annulus. The tortuous flow path causes a frictional pressure loss. The amount of the pressure loss is controlled by the inflation pressure of the inflatable packer element, by the shape of the annular grooves, and by the length of the inflatable packer element.

24 Claims, 6 Drawing Sheets

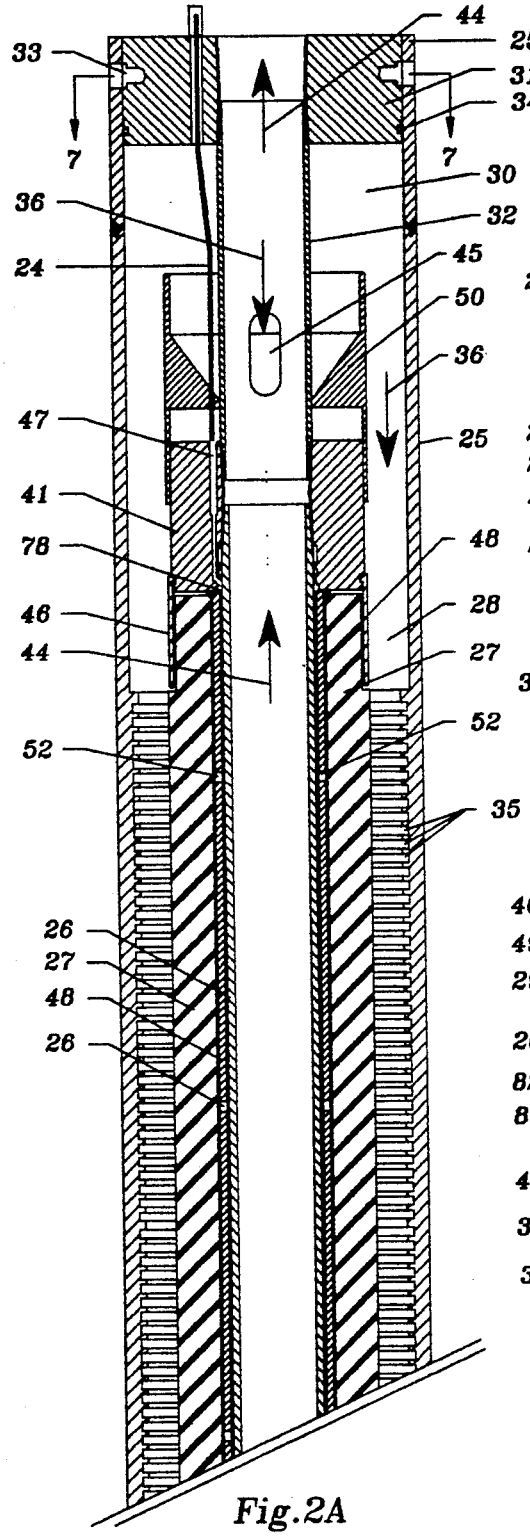
Fig.2A
Fig.2B
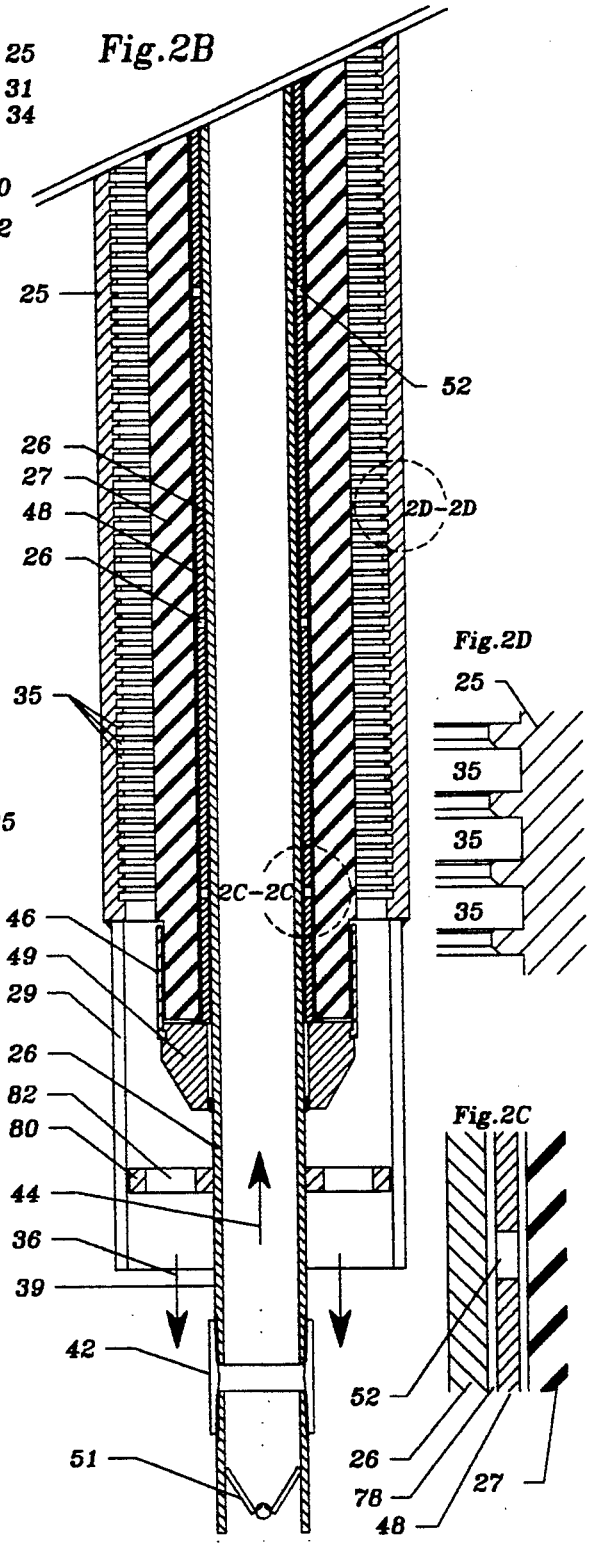
Fig.2D
Fig.2C 28
38
36
27
37
35
25

FLOW AND PRESSURE CONTROL PACKER VALVE

BACKGROUND OF THE INVENTION

1. Field of the Invention

The present invention relates to control valves for controlling the flow rate and pressure of a fluid. More particularly, the present invention relates to a control valve, constructed as a packer valve, adapted to control the direction and regulate the flow rate and pressure of a fluid flowing in a conduit, such as a well bore.

2. Description of the Prior Art

Inflatable packers for directing fluid flow in a fluid conduit are well known in the art. Typically, such inflatable packers are utilized in downhole applications for sealing a well bore (e.g., oil well or water well). As an example, a pair of such packers can be used in the testing of a drilled well formation by isolating a length of the formation in communication with a testing flow port.

In general, this type of packer includes an inflatable packer element which can be inflated to sealingly engage the inside diameter of the well bore. Fluid pressure for inflating the inflatable packer element is typically introduced through an operating string placed into the well bore, or by a separate pneumatic or hydraulic hose adjacent and external to the operating string. Such inflatable packers may also include some means for locking the inflatable packer element in an inflated or sealing condition. Packers can be a "multi-set packer" which can be deflated and re-inflated within a well bore, or a "single set packer" adapted for a single downhole inflation.

In the past, such inflatable packers have been constructed to either prevent or to permit fluid flow. Inflatable packers are thus not adapted to selectively regulate a fluid flow rate within a well bore.

It is often desirable to regulate the fluid flow rate or fluid pressures of fluids injected into or pumped out of a well. Recharge water wells, for instance, may be utilized in Aquifer Storage and Recovery (ASR) programs to assist communities during times when water demand peaks. The (ASR) process involves storing treated drinking water in suitable underground aquifers through recharge wells during low-demand months and recovering the water through the same wells during high demand months.

With such recharge wells, treated water is injected into the wells for storage. This injection is typically accomplished at a predetermined flow rate and pressure. Flow and pressure regulation is typically achieved utilizing a surface mounted flow control valve.

A variety of flow control valves are well known in the art for controlling fluid flow within a conduit. As an example, globe control valves are often utilized in high flow applications. Such control valves may include a spring actuated, tapered, sealing member that operates in conjunction with a contoured orifice. The location of the sealing member with respect to the orifice can be adjusted to provide a cross section which achieves a desired fluid flow rate and frictional pressure loss.

A problem with such flow control valves is that they cannot regulate a wide range of flows with the large pressure drops inherent in their design. Further, their size is such that they cannot fit in a well and allow pumping. Moreover, these control valves have a limited operating range because typically, a single sealing member and contoured orifice are utilized to achieve a large pressure drop. Control is difficult because only a small linear movement of the sealing member relative to the contoured orifice is required. In addition, with a single orifice valve, fluid flow velocities through the control valve are relatively large. Such high flow velocities produce hydrodynamic noise and promote cavitation within the control valve. Finally, a shortcoming of such prior art control valves is that because of their sensitivity, they are difficult to utilize with a fluid containing a particulate material (e.g., dirty water).

The present invention recognizes that a packer valve may be constructed as a control valve to direct fluid flow within a conduit and also to regulate fluid pressures and flow rates within the conduit. Moreover, such a packer valve can be constructed to achieve an infinitely variable frictional pressure loss for a fluid flowing through the packer valve. Further, such a packer valve can be constructed to achieve a high flow rate with a low fluid velocity through the valve. Still further, such a valve can be made of a size which permits it to be placed into a well.

Accordingly, it is an object of the present invention to provide a packer valve adapted to direct fluid flow within a fluid conduit such as a well.

It is another object of the present invention to provide such a packer valve that can be placed downhole in a well bore and controllable from the surface.

It is a further object of the present invention to provide such a packer valve in which fluid velocities through the valve are low and frictional pressure losses through the valve are infinitely variable to control fluid flow over a wide range of pressures whether down hole in a well or for such control in surface piping systems.

It is yet another object of the present invention to provide such a packer valve that can be used with a variety of fluids including a fluid having particulate material therein.

It is a further object of the present invention to provide a packer valve especially adapted for controlling the flow rate and pressure of a fluid injected into a well.

It is yet another object of the present invention to provide a packer valve suitable for high flow and high pressure applications that is simple and reliable.

It is yet another object of the present invention to provide a packer valve suitable to retrofit existing wells for pumping and injection.

SUMMARY OF THE INVENTION

In accordance with the present invention, a packer valve for controlling fluid flow and pressure in a fluid conduit such as a well bore is provided. In an illustrative embodiment, the packer valve is adapted to function as a two way valve for directing fluid flow into the well from the surface, or out of the well to the surface. The packer valve can be used to direct the flow of an injection fluid from the surface (e.g. treated water to be stored within the well) into the well bore and to regulate the flow rate and pressure of the injected fluid. The packer valve may also direct fluid flow to the surface from a submersible pump (or other pumping mechanism) in fluid communication with a pump pipe located within the well.

Generally stated, a packer valve constructed in accordance with the invention includes:

a generally cylindrically shaped housing adapted to fit within a well bore in fluid communication therewith and constructed with a length and with an inside diameter surface adapted to provide a pre-determined roughness factor for friction loss;

an elongated mandrel mounted within the housing and adapted for fluid communication at a downhole end with a pump pipe of the well and at an uphole end with an injection fluid source with the mandrel sized to minimize uphole flow friction losses; and an inflatable packer element, mounted within the housing, circumjacent to the mandrel to form an annulus between the outside diameter of the element and the inside diameter of the housing, with the annulus in communication with the well at the downhole end and the elongated mandrel at the uphole end, and with the inflatable packer element adapted to be inflated into the annulus to reduce the area of the annulus and thereby provide a flow path that achieves a predetermined pressure loss for fluid flow through the valve and into the well, as well as to shut off fluid flow into the well, allowing fluid flow to the surface.

INJECTION

For regulating the flow rate and fluid pressure of an injected fluid the housing and packer element are sized and adapted to accomplish four things: (1) the inside diameter of the housing of the packer valve is formed with a surface to increase the surface roughness thereby increasing friction to fluid movement (in an illustrated embodiment this comprises an arrangement of parallel spaced annular grooves to provide a series of annular orifices); (2) the length of the housing is sized to provide (in conjunction with the surface roughness of the inside diameter), an adequate total frictional loss to fluid movement as a specific differential pressure application may require; (3) the inflatable packer element is sized to expand into the annular area between the outside diameter of the packer and the inside diameter of the housing (the annulus) allowing for a range of flow rates from full flow with little frictional loss, through intermediate flows with varying frictional losses, to complete restriction of any flow (complete shutoff); (4) the housing outside diameter is sized to fit into the well. It should be noted here that the sizing and construction of the housing once completed for a specific application, cannot be changed in the field; that is, the adjustments to flow are controlled only by the varying areas of the annulus (effected by the pressure or volume changes of the packer element).

The inside of the housing provides a surface of significant roughness to increase frictional pressure losses to fluids. In the application of a recharge well with a liquid fluid, this roughness may be accomplished with annular grooves that circumscribe the inflatable packer element. If the inflation pressure within the inflatable packer element is high enough, the packer element expands and contacts the annular grooves and flow through the annulus of the valve is blocked, and affords a positive leak tight seal. With a lower predetermined inflation pressure, however, the inflated packer element only approaches close to the annular grooves, thereby providing a tortuous flow path for fluid flow between the inflatable packer element and the housing (the annulus). The annular grooves increase the friction loss of the flow, and the longer the housing, the more grooves there would be, and more friction loss. The grooves may be modeled as annular orifices, and the frictional loss attributable to each is, in part, a function of the shape of the annular grooves. The amount of the frictional pressure is determined by the shape of the annular grooves, the length of the housing (i.e. the number of grooves) and by the inflation pressure introduced into the packer element (which adjusts the annulus area).

In general, this frictional pressure loss is infinitely variable because the inflation pressure of the packer is infinitely variable (which allows an infinitely variable annulus area). By adjusting the inflation pressure (or inflation volume) to achieve a desired frictional pressure loss, the flow rate and pressure of a fluid injected into the well bore can be regulated as required. Moreover, because a large surface area is provided for pressure regulation by the annular grooves and housing length, low fluid velocities and high pressure drops are possible.

In use, such as for operating a recharge water well, the packer valve can be submerged into a well adjacent to a submersible pump of the well. The mandrel of the packer valve is connected at one end (downhole) in fluid communication with the submersible pump. A check valve located above the pump prevents injection fluids from passing into the pump from the surface. At an opposite end (uphole) the mandrel of the packer valve is in fluid communication with the pump pipe and a surface mounted pump for the injection fluid; and also in fluid communication with the top end of the housing. In a downhole injection mode, an injection fluid is introduced at the surface, and flows through the downhole connecting pipe and through the mandrel of the packer valve, and through an outlet orifice of the mandrel in flow communication with the annulus. The inflation pressure of the inflatable packer element is selected to allow some fluid flow to pass to the annulus. This tortuous flow path through the annulus along the length of the housing and its grooves provides a frictional pressure loss. The frictional pressure loss can be adjusted to provide a desired flow rate and pressure of the injection fluid.

During the injection mode of the packer valve, it is desirable to equalize the frictional pressure loss in a linear direction from an uphole end to a downhole end of the inflatable packer element. In general, this equal pressure distribution can be accomplished by forming the packer element with a variable stretch pressure along its length. As an example, for providing a variable stretch pressure, the inflatable packer element can be formed in segments with each segment having a different stretch pressure. An uphole end of the packer element can be formed with a lower stretch pressure than a downhole end to counteract the lower differential pressure between the injection fluid and the packer inflation pressure. The downhole end of the packer element can be formed with a higher stretch pressure (than the uphole end), to counteract the larger differential pressure between the lower injection fluid pressure, and the packer inflation pressure. The element may have several segments, each with a stretch pressure designed to provide a linear pressure loss across the valve.

The effect of high differential pressures from end to end of the packer valve is to increase the differences in stretch pressures of the element segments necessary to produce a linear pressure loss. This effect of the pressure differential can also be minimized by forming the inflatable packer element with a relatively high stretch pressures relative to the fluid pressure. This minimizes the effect of the uphole to downhole pressure differential, and in some specific applications may allow the use of single segment elements.

PUMPING

In an uphole pumping mode, the inflatable packer element is inflated with a pressure sufficient to prevent all fluid flow within the annulus. At the same time, the submersible pump is allowed to pump water from the well up through the check valve and mandrel of the packer valve, through the pump pipe, and to the surface. The packer flow control valve can also be installed above the bowl assembly of a vertical turbine pump. A check valve can be installed at the bottom of the bowl assembly.

Other objects, advantages, and capabilities of the present invention will become more apparent as the description proceeds.

BRIEF DESCRIPTION OF THE DRAWINGS

FIGS. 2A and 2B are partial cross sectional views of a packer valve constructed in accordance with the invention taken along section lines (2A—2B)—(2A—2B) of FIG. 1;

FIG. 2C is an enlarged cross sectional view taken along section line 2C—2C of FIG. 2B:

FIG. 2D is an enlarged cross sectional view taken along section line 2D—2D of FIG. 2B;

DETAILED DESCRIPTION OF THE INVENTION

Figure 1:
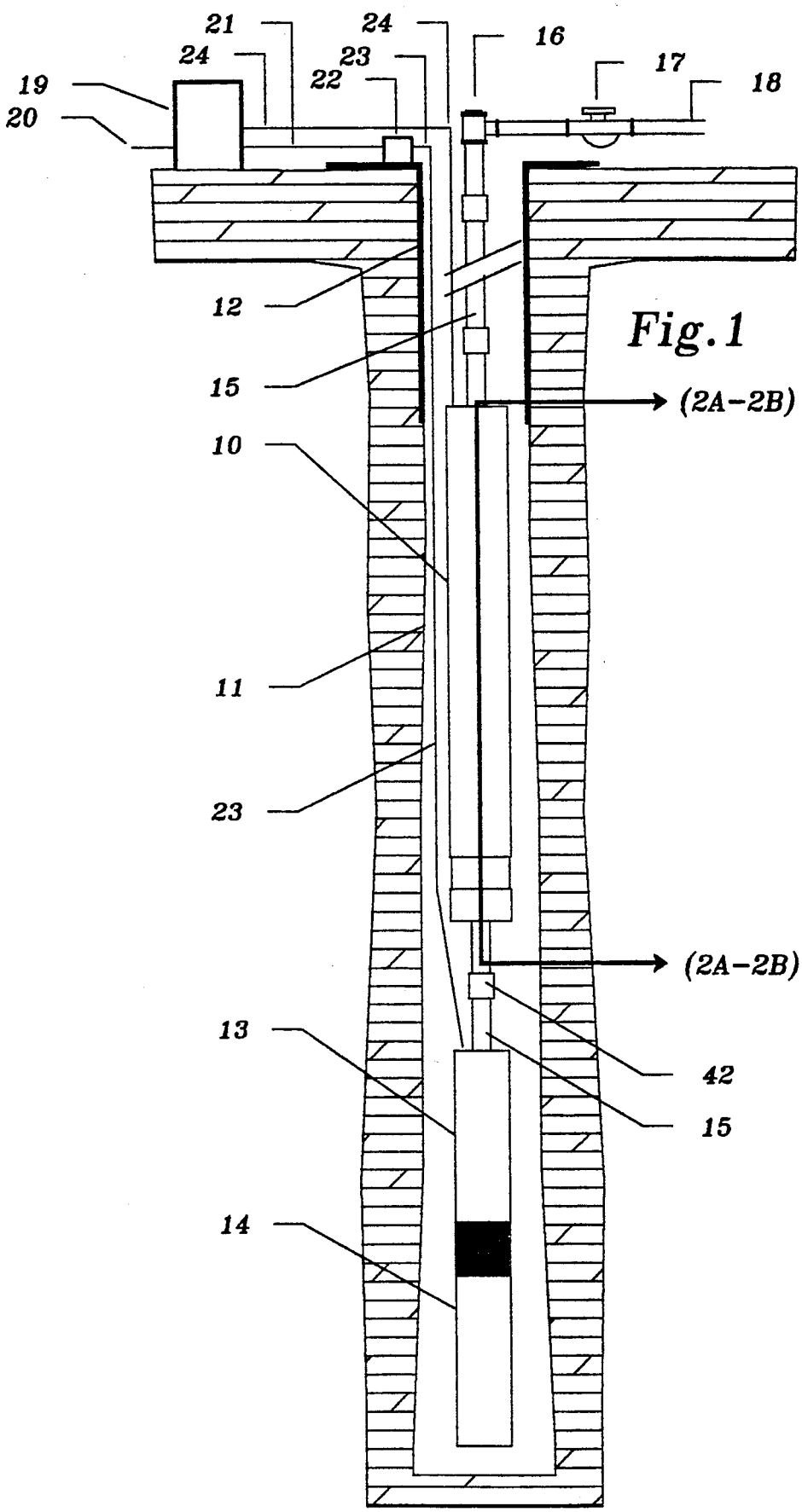
FIG. 1 is a schematic drawing of a recharge water well, with a packer valve constructed in accordance with the invention installed in the well, for controlling the direction, flow rate, and pressure of a fluid injected into the well.

Referring now to FIG. 1, a packer valve constructed in accordance with the invention is shown and generally designated as 10. The packer valve 10 is shown installed in a recharge water well which is generally designated as 11. The water well 11 is suitable for use in an Aquifer Storage and Recovery (ASR) program in which recharge water is injected into the well 11 for storage. The packer valve 10 is adapted to direct fluid flow and to control the flow rate and pressure of recharge water injected into the well 11.

Such an application for the packer valve, however, is merely exemplary. It is to be understood that a packer valve 10 constructed in accordance with the invention can be used for controlling the fluid flow rate and pressure in other fluid conduits, both downhole and above ground. Moreover, the packer valve 10 is adapted for use with a variety of fluids (e.g. oil, water, gas) including a dirty or gritty fluid, and fluids of different viscosities. Moreover, a pump means may be submersible pumps, turbine pumps, or other common means of retrieving water from wells (such as airlifting).

The recharge water well 11 includes a cylindrical well casing or bore 12 that extends from the ground surface into a desired geological formation. Typically, this may be a distance of from several hundred to several thousand feet. The well 11 also includes a submerged pump 13 and electric motor 14 for pumping water from the formation to the surface.

The submersible pump 13 is in flow communication with a downhole end of the packer valve 10. The packer valve 10 in turn, is in flow communication with a pump pipe 15 that extends to the surface. At the surface, the pump pipe couples to an elbow 16, a water meter 17, and a water supply conduit 18.

A control panel 19 located at the surface functions as a control means to control various aspects of the water well 11 such as electrical, pneumatic and timing functions. The control panel 19 connects to a power conduit 20. The control panel 19 also connects to an electrical conduit 21 which connects to a junction box 22. The junction box 22 connects to another electrical conduit 23 to the pump motor 14.

The control panel 19 also includes or is connected to a pneumatic source (e.g. compressor) in fluid communication with a pneumatic line 24. The pneumatic line 24 in turn connects to the packer valve 10 for supplying an inflation gas such as compressed air, or an inert gas to the packer valve 10. Alternately, in place of an inflation gas, a pressurized inflation fluid such as water, oil or other liquid may be used to inflate the packer valve 10. Moreover, the inflation gas or fluid need not be supplied continuously, as the packer valve 10, may be inflated and maintained in an inflated condition using suitable valving (not shown).

Referring now to FIGS. 2A-2D, the packer valve 10 is shown in detail. The packer valve 10, generally stated, includes; a housing 25; an elongated mandrel 26 mounted within the housing 25; and an inflatable packer element 27 mounted circumjacent to the mandrel 26.

The housing 25 is hollow and generally cylindrical in shape, and may be formed of a rigid material such as steel. An outside diameter of the housing 25 is sized to fit within the well casing 12 (FIG. 1). The inside diameter of the housing 25 is sized with respect to the outside diameter of the inflatable packer element 27 such that an annulus 28 is formed between the inside diameter of the housing 25 and the outside diameter of the inflatable packer element 27. (This annulus is more clearly shown in FIG. 5.)

A downhole end 29 of the housing 25 is open and an uphole end 30 of the housing 25 is closed. With the packer valve 10 placed within the well 11 (FIG. 1), the downhole end 29 of the housing 25 is in flow communication with the well 11. This permits an injection fluid to be injected into the annulus 28 of the packer valve 10 through the downhole end 29 of the housing 25 and into the well casing 11.

An uphole end 30 of the housing 25 is closed by a connection member 31. The connection member 31 functions to connect the packer valve 10 at an uphole end to the pump pipe 15 (FIG. 1) which carries water to the surface. The connection member 31 also functions to mount an uphole end 32 of the mandrel 26 within the housing 25 at an uphole end.

Figure 7:
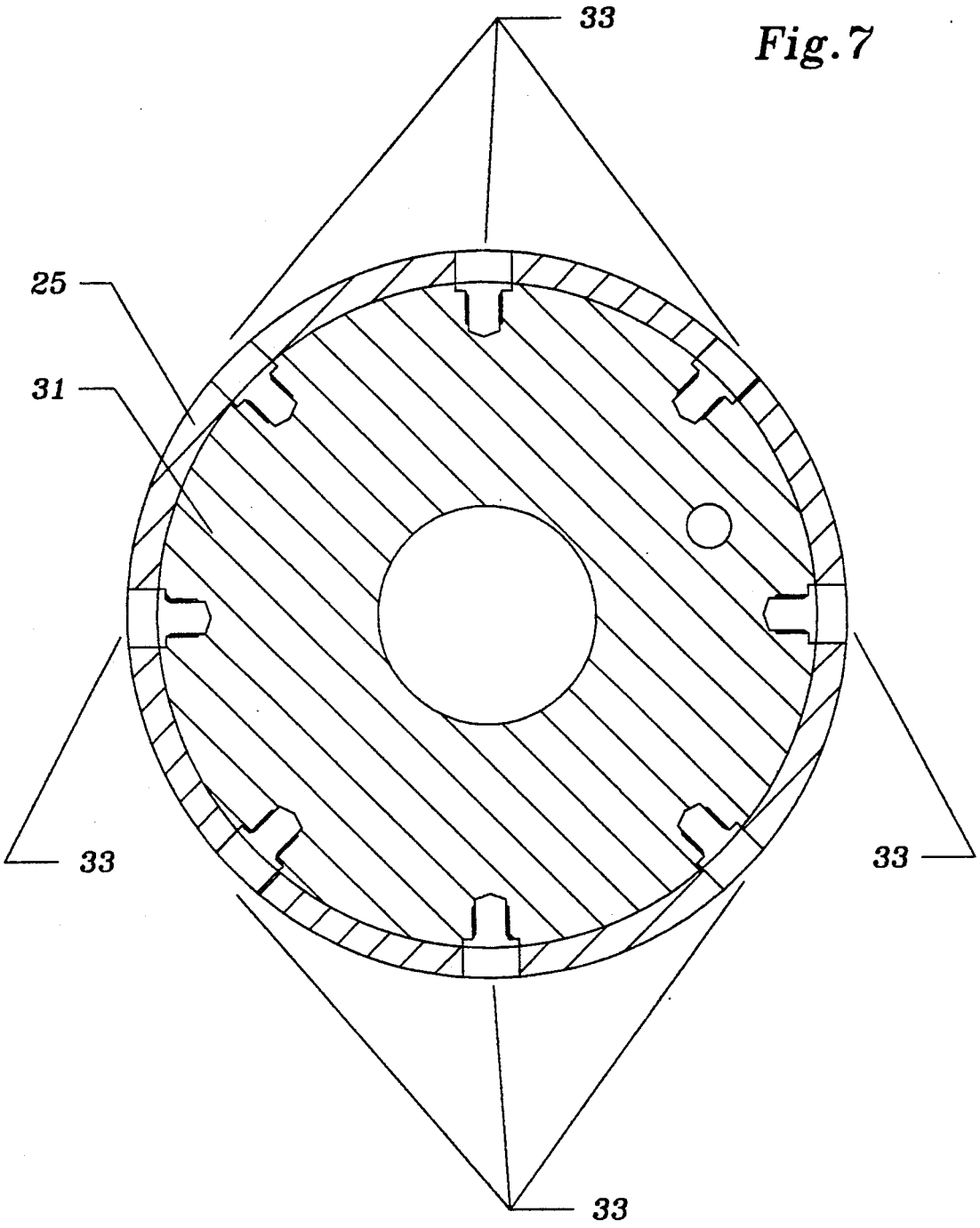
FIG. 7 is a cross sectional view taken along section line 7—7 of FIG. 2A.

The uphole end 32 of the mandrel 26 is attached to the connection member 31. As clearly shown in FIG. 7, the connection member 31 is formed with an arrangement of threaded openings for receiving mating capscrews 33. The capscrews 33 engage and retain the housing 25. An o-ring 34 (FIG. 2A) mounted within a groove seals the connection member 31 with respect to the annulus 28 of the packer valve 10.

As shown in FIGS. 2A and 2B, the inside diameter of the housing 25 in the area circumjacent to the inflatable packer element 27, is formed with a plurality of annular grooves 35. With the inflatable packer element 27 partially inflated, the annular grooves 35 provide a tortuous flow path for fluid flow within the annulus 28 in a downhole direction. This function of the annular grooves 35 is clearly shown in FIG. 3. The flow path 36 is between the inflatable packer element 27 and the annular grooves 35. This flow path 36 provides a predetermined frictional pressure loss for fluid flow. This pressure loss can be adjusted to allow the fluid flow rate and fluid pressure of storage water injected through the packer valve 10 to the well 11 to be regulated.

Figure 3:
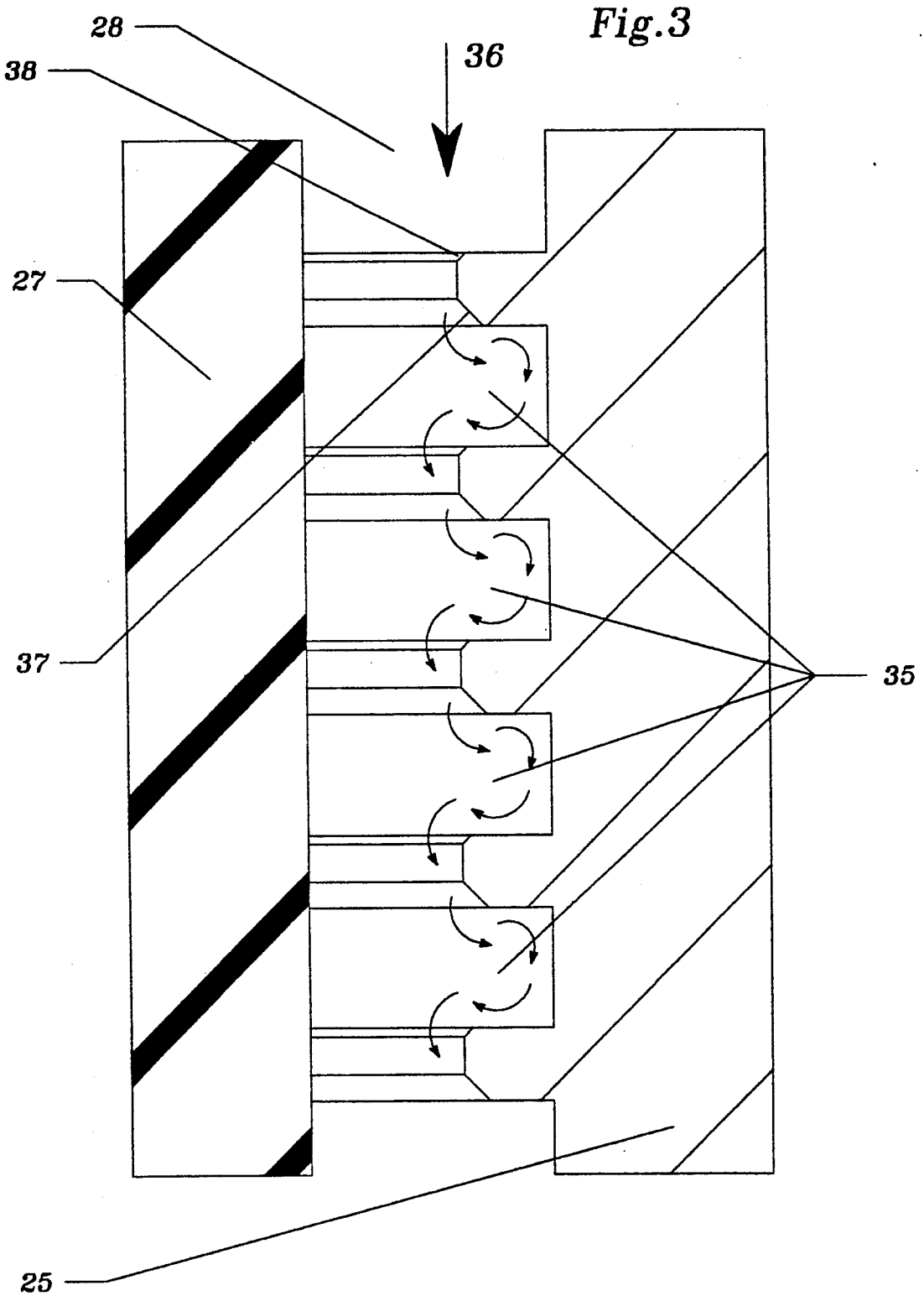
FIG. 3 is an enlarged schematic view of an annular groove of the packer valve shown in FIG. 2.

The amount of the frictional pressure loss through the packer valve 10 is a function of the annulus 28 remaining after partial inflation of the inflatable element 27. This annulus area is selectively controlled by the inflation pressure of the element 27 from the surface. In addition, the frictional pressure loss is a function of the shape of the annular grooves 35. This shape is substantially as shown in FIG. 3. Finally, this frictional pressure loss is a function of the length of the packer valve 10 and particularly the inflatable packer element 27.

As shown in FIG. 3, a downhole edge of each annular groove is heavily chamfered 37 to promote fluid flow into each annular groove 35. Conversely, an uphole edge of each annular groove 35 is lightly chamfered 38 to promote fluid retention within the grooves 35 to promote a friction loss of fluid flowing out of each annular groove 35. A frictional pressure loss is also achieved by the channeling and changing direction of the fluid flow within the annular grooves 35. This is indicated by the swirling flow paths within the grooves 35 in FIG. 3.

Referring back again to FIGS. 2A-2D, the mandrel 26 of the packer valve 10 is mounted within the housing 25 along a longitudinal axis of the housing 25. The mandrel 26 is hollow and generally cylindrical in shape and is adapted to provide a flow conduit for fluid flow pumped from the water well 11. As such, a downhole section 39 of the mandrel 26 is connected in flow communication with an output of the submersible pump 13 (FIG. 1) for the water well 11.

The mandrel 26 may be formed in separate sections, the uphole section 32 and the downhole section 39. As previously stated, the uphole section 32 of the mandrel 26 connects to the connection member 31 of the packer valve 10. The downhole section 39 of the mandrel 26 connects to the uphole section 32 at an upper packer collar 41 (FIG. 2A). Moreover, the uppef packer collar 41 is located at the upper end of the inflatable packer element 27 and connects to the inflatable packer element 27. The downhole section 39 of the mandrel 26 connects to the submersible pump 13 (FIG. 1). A coupling 42 connects the downhole section 39 of the mandrel 26 with the pump 13. A check valve 51 is located between the pump 13 and mandrel 26.

In addition to providing a conduit for fluid flow from the submersible pump 13 to the surface, the mandrel 26 is also sized and spaced with respect to the housing 25 to allow the annulus 28 formed between the outside diameter of the element 27 and the inside diameter of the housing 25 to provide a flow path for injection fluid flow (e.g. storage water) as indicated by injection arrows 36 into the well 11. The injection flow path into the packer valve 10 is from the pump pipe 15 into the uphole section 32 of the mandrel 26 (see also FIG. 5). A pumping flow path through the mandrel 26 is from the pump 13 to the mandrel 26 as indicated by pumping arrows 44 (see also FIG. 4).

The uphole section 32 of the mandrel 26 is formed with an elongated opening 45 (FIG. 2A) in flow communication with the annulus 28. With this arrangement, an injection fluid can flow from the interior of the uphole section 32 of the mandrel 26 through the elongated opening 45 and into the annulus 28. A particulate removing means 50 (FIG. 2A) surrounds the opening 45 to catch particulate material, such as sand or grit, that may be pumped in a pumping mode.

The inflatable packer element 27 is mounted to the upper section 32 of the mandrel 26 for inflation into the annulus 28. An upper packer collar 41 and element crimp collar 46 sealingly attaches the inflatable packer element 27 to the mandrel 26 and to a packer barb 48. The packer barb 48 is a generally cylindrical rigid support tube which extends the entire length of the inflatable packer element 27. An internal passageway 47 in the upper packer collar 41 is formed for introducing an inflation fluid from the pneumatic line 24 into an annulus 78 formed between the outside diameter of the mandrel 26 and the inside diameter of the packer barb 48. There are holes 52 along the length of the barb 48 for introduction of the inflation fluid to the inside diameter of the inflatable packer element 27 for inflation. The internal passageway 47, annulus 78 and holes 52 are in flow communication with the pneumatic line 24 (FIG. 1) which in turn is connected to a source of a compressed gas. The inflation source may also be a liquid. A lower packer collar 49 (FIG. 2C) and element crimp collar 46 similarly sealingly attaches the inflatable packer element 27 to the mandrel 26 and packer barb 48 at a downhole end.

At the downhole end of the housing 25 a centering plate 80 directs fluid flow in the injection mode into the well casing 12. The centering plate 80 is generally circular in shape and fits within the inside diameter of the housing. Orifices 82 are formed in the centering plate 80 for directing the injection fluid flow. The centering plate 80 also functions to center the location of the mandrel 26 with respect to the housing 25 at the downhole end 29.

The inflatable packer element 27 may be of any suitable length and is formed of a resilient material such as vulcanized rubber. The inflatable packer element 27 may be formed of several plies of cord or cable reinforcement (e.g. 2, 4, 6 or more plies) as is known in the art.

In an uninflated condition of the inflatable packer element 27, the flow path through the annulus 28 of the housing 25 is unrestricted. The inflatable packer element 27, however, can be inflated to press against the inside diameter of the housing 25 and the annular grooves 35 formed in the housing 25. In general, the packer element 27 will have a stretch pressure that must be overcome in order to inflate the packer element 27 to provide a contact force against the inside diameter of the housing 25. If the inflation pressure is high enough, the annulus 28 will be sealed, and no fluid flow will be permitted through the annulus 28 between the inflatable packer element 27 and the housing 25. Between these two extremes (completely open vs. completely sealed) however, the inflation pressure of the inflatable packer element 27 can be adjusted to achieve a desired flow path or size of the annulus 28 to regulate the fluid pressure and flow rate through the annulus 28.

The frictional pressure loss caused by the fluid flow between the inflatable packer element 27 and the annular grooves 35 can be used to achieve a desired fluid pressure drop and flow rate. This frictional pressure loss can be adjusted by adjusting the pressure in the inflatable packer element 27 from the surface. In general, since this inflation pressure is infinitely variable, the fluid pressure and flow rate within the annulus 28 are also infinitely variable. In addition, because a large number of annular grooves 35 can be formed with a relatively large surface area, relatively large pressure losses and flow rates can be achieved, even with relatively small flow velocities.

In general, it is desirable to provide a pressure drop from an uphole end to a downhole end of the packer valve 10 that is approximately the same throughout the length of the packer valve (i.e. from end to end of the packer valve 10). Since the uphole end of the inflatable packer element 27 however, is subjected to a higher pressure of the injection fluid, the uphole end must have a lower stretch pressure (or be inflated to a higher pressure) than the downstream end to achieve the same frictional pressure.

Figure 6:
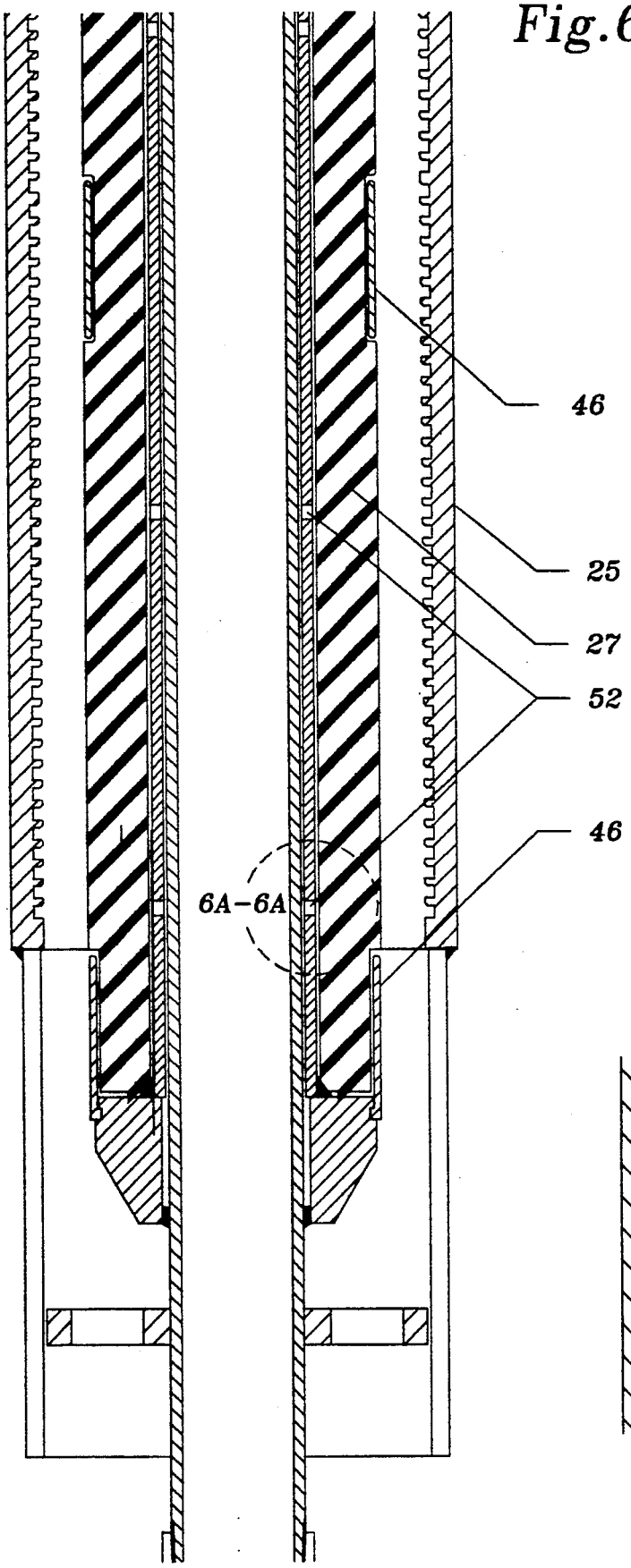
FIG. 6 is a schematic drawing of an inflatable element of a packer valve constructed in accordance with the invention segmented with crimp collars along its length for regulating stretch or diameter of the segments.
Figure 6A:
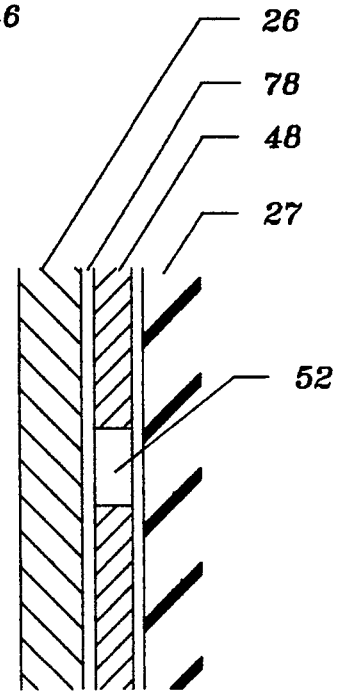
FIG. 6A is an enlarged cross sectional view taken along section line 6A—6A of FIG. 6.

In order to achieve this desired pressure distribution, the inflatable packer element 27 may be constructed in segments (e.g., 2 or more segments). The uphole segments can be made with a lower stretch pressure relative to the downhole segments. FIG. 6 schematically depicts the use of element crimp collars 46 to separate the different segments of the inflatable element 27 and secure them to the packer barb 48. The different segments of the inflatable packer element 27 may be formed with different stretch pressures by techniques which are known in the art, such as by varying the thickness of the packer element 27 across its length; varying durometer (hardness) of the rubber; varying the numbers of reinforcement plies; varying the angle of the cord reinforcements in relation to the axis of the element; or a combination of the above.

As an alternative to element segmentation, in order to overcome this unequal uphole to downhole pressure differential, the stretch pressure of the inflatable packer element 27 can be made relatively high in comparison to the fluid pressure of the injection fluid. The effects of the pressure differential will thus be minimized.

OPERATION

Figure 4:
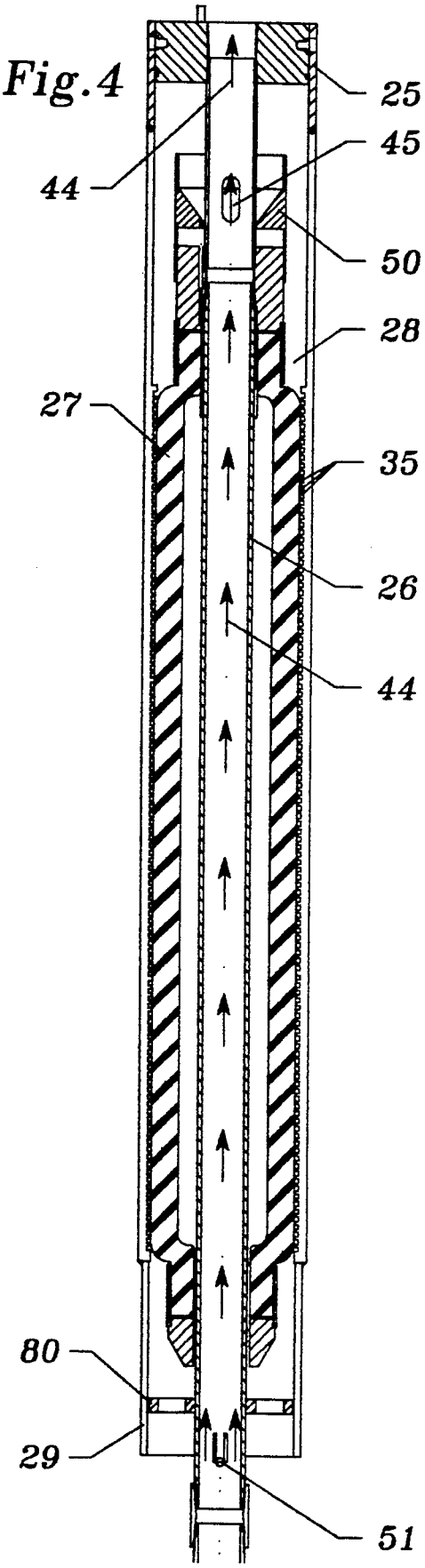
FIG. 4 is a schematic drawing of a packer valve constructed in accordance with the invention, shown in use in a recharge water well in an uphole pumping mode, for pumping water from the well.
Figure 5:
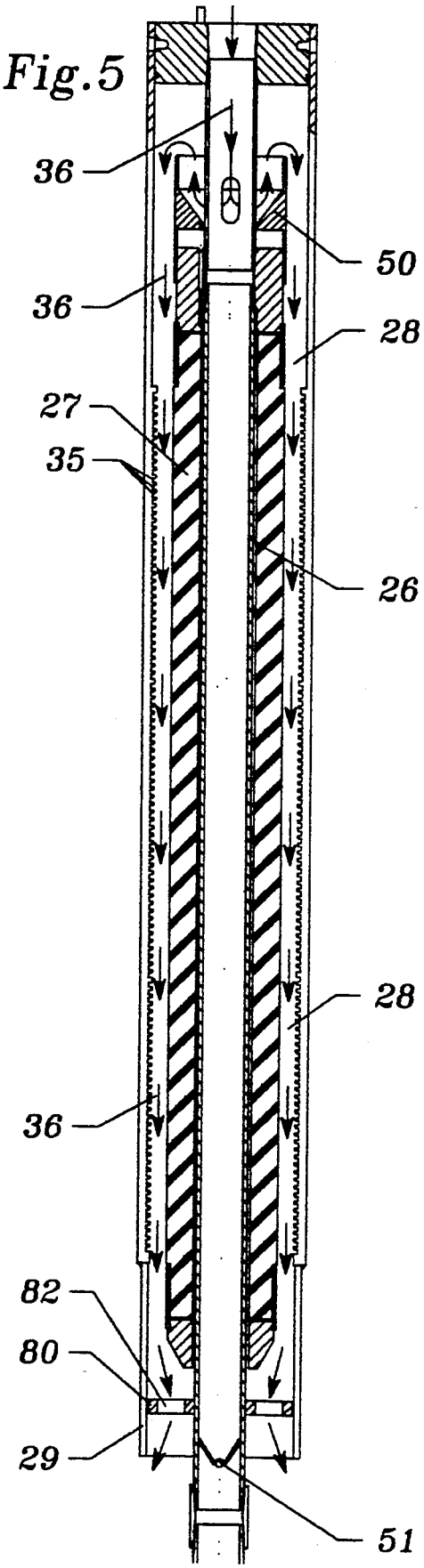
FIG. 5 is a schematic drawing of a packer valve constructed in accordance with the invention, shown in use in a recharge water well in a downhole injection mode for injecting water into the well.

Referring now to FIGS. 4 and 5, the operation of the packer valve 10 can be explained. FIG. 4 shows an uphole pumping mode of the packer valve 10. In an uphole pumping mode, water is being pumped from the well 11 to the surface. In this mode, the inflatable packer element 27 is inflated with a pressure high enough to press against the inside diameter of the housing 25 and completely seal the annulus 28. This sealing pressure is high enough to prevent any flow through the annular grooves 35 in the housing 25. At the same time, the submersible pump 13 (FIG. 1) is allowed to pump water from the well through the mandrel 26 of the packer valve 10, and to the surface. Pumping flow direction is shown with arrows 44.

FIG. 5 shows a downhole injection mode of the packer valve. In a downhole injection mode, water is being injected from the surface into the well 11 for storage. In this mode, water is injected through the pump pipe 15 and flows through the opening 45 in the mandrel 26 of the packer valve 10 into the annulus 28. A check valve 51 located between the packer valve 10 and submersible pump 13 prevents fluid flow into the pump 13 during the downhole injection mode. Flow direction during the injection mode is shown with arrows 36.

In the downhole injection mode, the pressure and flow rate of the fluid injected into the annulus 28 is controlled by the inflation pressure (or inflation volume) of the inflatable packer element 27 which directly affects the annular area 28. In this mode, the inflatable packer element 27 is inflated with a pressure that causes the inflatable packer element 27 to come close to the inside diameter of the housing 25 thereby reducing the annular area 28. This inflation pressure is selected to allow fluid to flow between the inflatable packer element 27 and the annular grooves 35. This produces a frictional pressure loss as previously explained. The pressure loss is also affected by the length of the inflatable packer element 27. For a large pressure drop therefore the inflatable packers element 27 must be relatively long.

The amount of the frictional pressure loss can be varied by varying the area of the annulus 28. The annulus area can be varied by the inflation pressure of the inflatable packer element 27 or the volumetric amount of liquid added to the packer element 27. A desired flow rate and pressure for the injection fluid into the well can thus be achieved. Since the pressure drop is achieved over a relatively large surface area, large pressure drops with a low flow velocity can be achieved. In addition, an infinitely variable range of fluid pressure and flow rates can be achieved. Finally the packer valve can be utilized with a variety of fluids including a gritty or dirty fluid.

DESIGN CONSIDERATION

As is apparent, the size of the annulus 28 or annular gap is the only control element after installation of the packer valve. This annular gap is controlled by the outside diameter of the packer, and is a function of the pressure inside of the packer, regulated from the surface; or the volume inside the packer, again regulated from the surface. The volume and inside pressure are related, and are a function of the downhole conditions.

Initial design of the packer valve requires sizing of the mandrel inside diameter to allow for adequate flow to the surface without excessive friction loss. Initial design of the packer requires sizing of the o.d. of the packer and the i.d. of the housing to, similarly, allow for adequate flow for injection. And, finally, the outside diameter of the housing itself must be sized to fit in the borehole or pipe. Typically, either a gas or a liquid is treated as a fluid.

Thus the invention provides a packer valve that can be used to regulate fluid pressure and flow rates in a fluid conduit. While the invention has been described in connection with an illustrative embodiment for injecting water into a recharge water well, it is to be understood that the invention can be used in a variety of other applications and with other fluids. As will be apparent then, to those skilled in the art, certain changes and modifications can be made without departing from the scope of the invention as defined by the following claims.

What is claimed is:

1. A packer valve for controlling a fluid flow rate in a conduit, comprising:

a housing formed with an inside diameter and adapted to be placed within the conduit in fluid communication therewith; and an inflatable packer element mounted within the housing and adapted to be inflated to vary the annular area between the inside diameter of the housing and the outside diameter of the packer, thereby providing a flow path between the housing and inflatable packer element for regulating a fluid flow rate and pressure within the conduit.

2. The packer valve as recited in claim 1 and wherein the inside diameter of the housing is formed with a surface to provide a flow path that produces a frictional pressure loss.

3. The packer valve as recited in claim 2 and wherein the frictional pressure loss is controlled by an inflation pressure, by a roughness of the surface, and by a length of the inflatable packer element.

4. The packer valve as recited in claim 3 and wherein the inflatable packer element is constructed to provide a substantially constant frictional pressure loss from end to end.

5. The packer valve as recited in claim 4 and wherein the inflatable packer element is formed in segments each having a different stretch pressure as may be required to provide a substantially constant frictional pressure loss from end to end.

6. The packer valve as recited in claim 5 and wherein the packer element is adapted to fit downhole within a well bore.

7. A packer valve for controlling a fluid flow rate and pressure in a well bore, comprising;

a generally cylindrically shaped housing in fluid communication with the well bore;

a hollow mandrel mounted within the housing in fluid communication with the housing and with a pump means of the well; and an inflatable packer element mounted to the mandrel and adapted to be inflated with a selected inflation pressure either to contact an inside diameter of the housing for preventing fluid flow through the housing, or to form a variable size annulus to provide a flow path between the inflatable packer element and the housing to produce a variable frictional pressure loss for fluid flow.

8. The packer valve as recited in claim 7 and wherein the inside diameter of the housing is formed with a surface to provide a frictional pressure loss for fluid flow.

9. The packer valve as recited in claim 8 and wherein the inside diameter of the housing is formed with a plurality of annular grooves to provide a tortuous fluid flow path between the housing and inflatable packer element.

10. The packer valve as recited in claim 9 and wherein a frictional pressure loss is determined by the inflated diameter of the element which adjusts the annular area between the element and the housing.

11. The packer valve as recited in claim 10 and wherein the frictional pressure loss is further determined by a length of the inflatable packer element.

12. The packer valve as recited in claim 11 and wherein the inflatable packer element is inflated with a compressed gas.

13. The packer valve as recited in claim 11 and wherein the inflatable packer element is inflated with a pressurized fluid.

14. The packer valve as recited in claim 11 and further comprising means for preventing particulate material from flowing into the annulus.

15. The packer valve as recited in claim 11 and wherein the inflation of the inflatable packer element is controlled from a surface mounted control means.

16. In a well having a well bore and a pumping means attached to a pump pipe within the well bore, a packer valve for controlling fluid pressure and flow rate of a fluid injected into the well, said packer valve comprising:

a generally cylindrical shaped housing adapted to be placed within the well bore, closed at an uphole end and formed with an open downhole end for flow communication with the well bore, and having an inside diameter formed with a plurality of annular grooves;

an elongated mandrel mounted to the housing and adapted to be connected to the pump pipe in flow communication therewith, and formed with an opening for flow communication with the well bore; and an inflatable packer element mounted within the housing to the mandrel and inflatable to contact the inside diameter of the housing or adjust the annular area between the housing and element to form a tortuous flow path for fluid flow through the annular grooves.

17. The packer valve as recited in claim 16 and further comprising means for preventing particular material from entering into the annular area.

18. The packer valve as recited in claim 16 and wherein the well is a recharge water well and the packer valve controls the fluid flow rate and pressure of water injected into the well for storage.

19. The packer valve as recited in claim 16 and wherein the inflatable packer element is formed in segments each having a different stretch pressure such that a frictional pressure loss from an uphole end to a downhole end of the packer valve is substantially constant.

20. The packer valve as recited in claim 16 and wherein the stretch pressure of the inflatable packer element is relatively higher than a fluid pressure within the annulus to minimize diameter changes from end to end of the packer element.

21. The packer valve as recited in claim 16 and wherein the annular grooves are formed with chamfered ends that allow fluid flow into the grooves but restrict fluid flow from the grooves.

22. The packer valve as recited in claim 16 and wherein a length of the housing is adjusted to achieve a desired pressure loss through the packer valve.

23. A packer valve for controlling a fluid flow rate and pressure in a well bore, comprising:

a generally cylindrically shaped housing adapted to fit within a well bore in fluid communication therewith and constructed with a length and with an inside diameter surface adapted to provide a predetermined roughness factor for friction loss;

an elongated mandrel mounted within the housing and adapted for fluid communication at a downhole end with a pump pipe of the well and at an uphole end with an injection fluid source;

an inflatable packer element, mounted within the housing, circumjacent to the mandrel to form an annulus between the outside diameter of the element and the inside diameter of the housing, with the annulus in communication with the well at the downhole end and the elongated mandrel at the uphole end, and with the inflatable packer element adapted to be inflated into the annulus to reduce the area of the annulus and thereby provide a flow path that achieves a predetermined pressure loss for fluid flow through the valve and into the well, as well as to shut off flow into the well, for allowing flow through the mandrel to the surface.

24. The packer valve as recited in claim 23 and wherein the inside diameter of the housing is formed with a plurality of annular grooves to provide a tortuous fluid flow path.

* * * * *